US010991569B2

(12) United States Patent
Grothmann

(10) Patent No.: US 10,991,569 B2
(45) Date of Patent: Apr. 27, 2021

(54) ELECTRODE ARRANGEMENT FOR A DISCHARGE LAMP, GAS DISCHARGE LAMP, PROTECTIVE FILM AND METHOD FOR PROVIDING A PROTECTIVE FILM ON AN ELECTRODE ARRANGEMENT

(71) Applicant: OSRAM GmbH, Munich (DE)

(72) Inventor: Knut Grothmann, Berlin (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 16/799,876

(22) Filed: Feb. 25, 2020

(65) Prior Publication Data

US 2020/0273694 A1 Aug. 27, 2020

(30) Foreign Application Priority Data

Feb. 25, 2019 (DE) ..... 10 2019 202 479.3

(51) Int. Cl.
*H01J 61/86* (2006.01)
*H01J 61/36* (2006.01)
(Continued)

(52) U.S. Cl.
CPC ..... *H01J 61/86* (2013.01); *H01J 9/28* (2013.01); *H01J 61/0735* (2013.01); *H01J 61/366* (2013.01); *H01J 61/822* (2013.01)

(58) Field of Classification Search
CPC ..... H01J 61/86; H01J 61/0735; H01J 61/366; H01J 61/822; H01J 9/28
See application file for complete search history.

(56) References Cited

U.S. PATENT DOCUMENTS 4,808,881 A * 2/1989 Kariya ..... H01J 61/366 313/624
6,366,019 B1 * 4/2002 Wada ..... H01J 61/0732 313/570

(Continued)

FOREIGN PATENT DOCUMENTS

DE 19618967 A1 11/1996
DE 102004002455 A1 9/2004
DE 102009053632 A1 6/2010

OTHER PUBLICATIONS

German Search Report issued for corresponding DE application No. DE 2019 202 479.3, dated Sep. 26, 2019, 7 pages (for informational purpose only).

*Primary Examiner* — Anne M Hines
(74) *Attorney, Agent, or Firm* — Viering, Jentschura & Partner MBB

(57) ABSTRACT

An electrode arrangement for a discharge lamp is provided, including an electrode unit including an electrode and an electrode plate, and a conductive connection unit for coupling to an energy source. The connection unit includes a connection unit plate. The arrangement includes a cylinder composed of a nonconductive material, said cylinder arranged between the electrode plate and the connection unit plate, and at least one conduction film which is arranged on an outer side of the cylinder and extends from the connection unit plate as far as the electrode plate and connects the connection unit plate and the electrode plate to one another. The arrangement includes a cap-shaped and integrally embodied protective film arranged on the electrode plate or connection unit plate, such that the film covers a plate side facing away from the cylinder and an outer lateral surface of the electrode plate or of the connection unit plate.

10 Claims, 2 Drawing Sheets

(51) Int. Cl.

| | |
|---|---|
| ***H01J 9/28*** | (2006.01) |
| ***H01J 61/073*** | (2006.01) |
| ***H01J 61/82*** | (2006.01) |

(56) References Cited

U.S. PATENT DOCUMENTS

| | | | | |
|---|---|---|---|---|
| 2004/0178732 | A1 | 9/2004 | Mittler | |
| 2010/0060164 | A1* | 3/2010 | Kuenzler ..... | H01J 61/366<br>313/623 |
| 2010/0141142 | A1 | 6/2010 | Matoba et al. | |

* cited by examiner

ELECTRODE ARRANGEMENT FOR A DISCHARGE LAMP, GAS DISCHARGE LAMP, PROTECTIVE FILM AND METHOD FOR PROVIDING A PROTECTIVE FILM ON AN ELECTRODE ARRANGEMENT

CROSS-REFERENCE TO RELATED APPLICATION

This application claims priority to German Patent Application Serial No. 10 2019 202 479.3, which was filed Feb. 25, 2019, and is incorporated herein by reference in its entirety.

TECHNICAL FIELD

Various embodiments relate generally to an electrode arrangement for a discharge lamp, said electrode arrangement including an electrically conductive electrode unit including an electrode and an electrode plate, on which the electrode is arranged. Furthermore, the electrode arrangement includes an electrically conductive connection unit for coupling to an energy source. The connection unit includes a connection unit plate. Moreover, the electrode arrangement includes a cylinder composed of an electrically nonconductive material, said cylinder being arranged between the electrode plate and the connection unit plate, and at least one electrically conductive conduction film which is arranged on at least one part of an outer side of the cylinder and extends from the connection unit plate as far as the electrode plate and electrically conductively connects the connection unit plate and the electrode plate to one another. Various embodiments also include a gas discharge lamp including such an electrode arrangement, a protective film for an electrode arrangement, and a method for providing a protective film on an electrode arrangement for a discharge lamp.

BACKGROUND

Various embodiments generally belong to the field of electrode arrangements or electrode systems for discharge lamps, specifically to the field of discharge lamps having all-round film sealing systems, and can find application here e.g. both for DC discharge lamps and for AC discharge lamps. Such discharge lamps usually include two above-described electrode arrangements arranged in a quartz glass bulb in a manner lying coaxially with respect to one another. In particular, said electrode arrangements are arranged here within such a bulb in such a way that the electrode tips facing one another and in particular also a large part of the abovementioned electrode arrangement are situated within said bulb, while at least part of the connection unit for coupling to the energy source, in particular for providing the power supply, is situated outside said bulb.

The bulb has to be closed in an air-tight fashion, which is normally achieved by this outer glass bulb being fused to the electrode arrangement or electrode arrangements at high temperatures. It is problematic in this case if metal components are fused to glass in this case since mechanical stresses can occur on account of temperature changes during fusion or else during later operation, which mechanical stresses arise as a result of the different coefficients of thermal expansion of the materials and can in turn lead to cracks in the quartz glass. Therefore, by way of example, the cylinder composed of the material that is not electrically conductive, said cylinder being arranged between the electrode plate and the connection unit plate, is usually likewise formed from quartz glass, such that it can be fused to the glass bulb, without any stresses on account of differences in thermal expansion having to be feared during operation. Therefore, the contacting between the connection unit plate and the electrode plate is also realized by at least one electrically conductive conduction film arranged on the outer side of the cylinder. Such a film, which is correspondingly also usually composed of metallic material, can then be made correspondingly thin, such that during the process of sealing in said film or fusing said film to the surrounding glass bulb, appreciable mechanical stresses on account of the different coefficients of thermal expansion likewise do not occur. What is problematic, however, is primarily the contact—arising during fusion—between the molten quartz glass of the glass bulb and the electrode plate, and in particular also the connection unit plate. Here, the different coefficients of expansion can lead to cracks in the quartz glass which, in the case of an unfavorable position and direction of propagation, result in a defect in the vacuum-tight seal.

In order to prevent this, it is conventionally provided to cover the plates, that is to say for example the electrode plate and/or the connection unit plate, with a metal film as protective film. This protective film is intended to prevent quartz glass from adhering to the electrode plate through the outer glass bulb and the film can absorb material stresses between quartz and metal plate perpendicular to the film surface. In this case, said film, for example for covering the electrode plate, is embodied in two parts, first as a disk having a hole for the electrode. The disk is then correspondingly arranged on that side of the electrode plate on which the electrode is also arranged centrally, such that this ring-shaped disk surrounds the electrode attachment point, as far as the edge of the electrode plate. Furthermore, a separate protective film strip is provided for the outer radius of the electrode plate. This film strip is secured on the circumference with the aid of resistance welds.

However, the abovementioned electrically conductive conduction film lies below said strip at least regionally, said conduction film electrically conductively connecting the two plates, that is to say the connection unit plate and the electrode plate, to one another. Said conduction film is also welded on. As a result of the overlying film strip of the protective film, this film strip likewise being welded on, this second weld can, however, damage the underlying first weld. This can impair both the conductivity and the stability of the electrode arrangement.

SUMMARY

An electrode arrangement for a discharge lamp is provided, including an electrode unit including an electrode and an electrode plate, and a conductive connection unit for coupling to an energy source. The connection unit includes a connection unit plate. The arrangement includes a cylinder composed of a nonconductive material, said cylinder arranged between the electrode plate and the connection unit plate, and at least one conduction film which is arranged on an outer side of the cylinder and extends from the connection unit plate as far as the electrode plate and connects the connection unit plate and the electrode plate to one another. The arrangement includes a cap-shaped and integrally embodied protective film arranged on the electrode plate or connection unit plate, such that the film covers a plate side facing away from the cylinder and an outer lateral surface of the electrode plate or of the connection unit plate.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
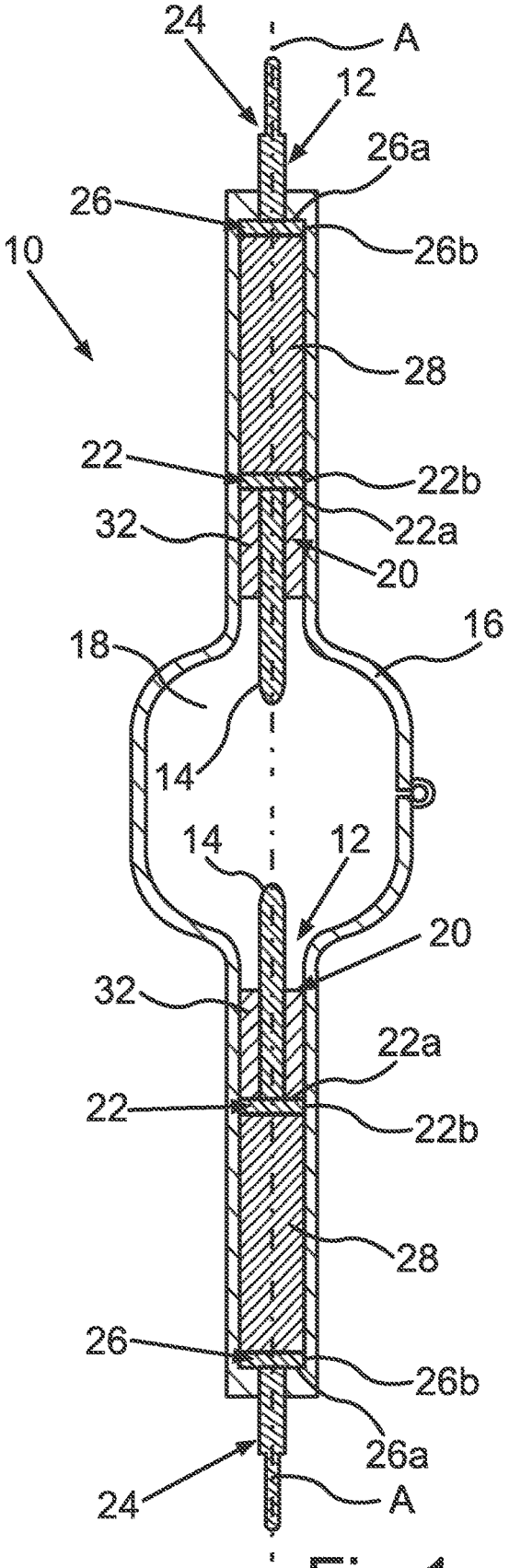
FIG. 1 shows a schematic cross-sectional illustration of a gas discharge lamp including two electrode arrangements in accordance with various embodiments.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

Various embodiments may provide an electrode arrangement, a gas discharge lamp, a protective film for an electrode arrangement, and a method for providing a protective film on an electrode arrangement which make it possible for mechanical stresses caused by different coefficients of thermal expansion to be prevented to the greatest possible extent, without possible damage to other components having to be accepted in this case.

An electrode arrangement according to various embodiments for a discharge lamp includes an electrically conductive electrode unit including an electrode and an electrode plate, on which the electrode is arranged, an electrically conductive connection unit for coupling to an energy source. The connection unit includes a connection unit plate, and a cylinder composed of an electrically nonconductive material, said cylinder being arranged between the electrode plate and the connection unit plate. Furthermore, the electrode arrangement includes at least one electrically conductive conduction film which is arranged on at least one part of an outer side of the cylinder and extends from the connection unit plate as far as the electrode plate and electrically conductively connects the connection unit plate and the electrode plate to one another. Furthermore, the electrode arrangement includes a cap-shaped and integrally embodied protective film arranged on the electrode plate or connection unit plate, such that the protective film at least for the most part, e.g. completely, covers a plate side facing away from the cylinder and an outer lateral surface of the electrode plate or of the connection unit plate.

By virtue of the fact that the protective film firstly is embodied integrally, that is to say at the latest when being arranged on the electrode plate does not consist of a plurality of separate individual parts, and secondly is moreover embodied in a cap-shaped fashion, said protective film can be placed onto the electrode plate in a simple manner. The electrode can be inserted for example through a corresponding hole in the protective film, such that that part of the protective film which covers the outer lateral surface of the electrode plate is thus automatically also arranged on the electrode arrangement or the electrode plate, without in this case having to be fixedly welded or else having to be secured in some other way. The same applies to the case where this protective film embodied in a cap-shaped fashion and integrally is intended to be arranged on the connection unit plate. In this case, too, it is possible for the cap-shaped protective film to be placed onto said connection unit plate in a simple manner, without the protective film, e.g. in the region of the outer lateral surface of the protective film, having to be welded on or secured in some other way. In other words, the protective film can be placed onto the relevant plate in a simple manner, and the electrode arrangement can subsequently be sealed in the glass bulb, as a result of which the film firstly is fixed between the electrode arrangement or the rest of the electrode arrangement and the glass bulb and secondly, as a result of the covering of the electrode plate or respectively the connection unit plate, prevents a direct contact between the molten quartz glass of the glass bulb and the electrode plate or respectively the connection unit plate. By virtue of the film, it is then possible, as described in the introduction, to avoid material stresses between quartz and the electrode plate or respectively the connection unit plate and thus efficiently to prevent possible flaws or cracks, particularly in the glass bulb. Since the cap-shaped, integrally embodied protective film can be arranged on the electrode plate or respectively the connection unit plate without additional welding, the arrangement of this protective film also cannot result in damage to the conduction film on the cylinder or the securing thereof or the welding thereof for securing said conduction film on the electrode plate or respectively the connection unit plate. A plurality of effects achieved over previous solutions can thus immediately be achieved by means of the cap-shaped and integrally embodied protective film. As already described, it may be possible to avoid a weld on the current-carrying conduction film that has already been welded, as a result of which subsequent damage to the first weld can be avoided. The mounting of the cap, that is to say of the cap-shaped protective film, without securing by means of welding furthermore has the effect that there are no welding points as starting points for cracks on the circumference. The cap additionally affords the advantage that between the end side of the cap and its circumference there is a preformed bent edge rather than—as in the previous in-house solution—two cut edges, which can be starting points for glass stresses and cracks.

In this case, an integrally embodied protective film should generally also be understood to mean a protective film which can optionally also be composed of a plurality of individual parts. The individual parts for example are cohesively connected to one another or were joined together in some other way. However, the protective film is present in integral form already prior to being fitted to the electrode plate. It may be provided, for example, if the protective film is not composed of a plurality of individual parts, but rather consists of only one individual part, and for example was cut out and/or stamped out as a single such part from a film and was subsequently shaped to form the cap in a suitable manner. Such a protective film composed of only one individual part correspondingly has no joints and is simpler to produce.

The cylinder composed of the electrically nonconductive material may be formed from quartz glass. Since the glass bulb in which the electrode arrangement is intended to be introduced in order to produce a gas discharge lamp is preferably also formed from quartz glass, this has the effect that the same or at least a comparable material can be used here, such that identical or only slightly different coefficients of thermal expansion are present as well and the risk of stresses and cracks caused by different coefficients of thermal expansion can be eliminated. The electrically conductive components of the electrode arrangement may be formed from molybdenum at least for the most part. It is thus provided for the electrically conductive conduction film to constitute a molybdenum film, and also for at least the electrode plate to be formed from molybdenum or tungsten, e.g. also the connection unit plate, as well as the protective film itself. That part of the electrode itself which begins at the electrode plate can also be formed from molybdenum or tungsten or include molybdenum. In principle, however, it is also possible to use other metals for providing the electrically conductive components of the electrode arrangement. In this case, it may be provided, however, if the same electrically conductive material, e.g. metal, is used at least for the conductive conduction film, the protective film and also for the two plates, since additional mechanical stresses caused by different metallic materials can thus be avoided.

Furthermore, it is also possible for a plurality of electrically conductive conduction films to be arranged on the outer side of the cylinder and to extend in each case from the connection unit plate as far as the electrode plate. By way of example, two to four or else a plurality of such conduction film strips can be provided, which are spaced apart from one another in each case in a circumferential direction. The electrode can furthermore constitute an anode or a cathode, in particular in the case where the electrode arrangement is provided for a DC discharge lamp. In the case of an AC discharge lamp, the electrode constitutes an anode and a cathode alternately.

In general, the electrode can be embodied as a cylindrical rod having an electrode tip facing away from the electrode plate or an electrode end piece on which the arc touches down. The electrode rod can be arranged centrally on the electrode plate, such that the axis of the electrode corresponds to the center axis of the electrode plate, which may likewise be embodied cylindrically. The connection unit plate can also be embodied cylindrically. Furthermore, it may be provided for the connection unit plate, the electrode plate and the cylinder situated therebetween, said cylinder being e.g. directly adjacent to the respective plates, to have the same diameter and for all these components to be arranged coaxially with respect to one another.

Moreover, the electrode arrangement may include a second cylinder composed of an electrically nonconductive material, e.g. once again quartz glass, said second cylinder having along its cylinder axis a through opening through which the electrode is led, such that said second cylinder touches down on the electrode plate, e.g. such that the protective film described is situated between the electrode plate and this second glass cylinder. The seating of the protective film on the electrode plate is additionally stabilized as a result and, moreover, this second glass cylinder prevents quartz glass of the glass bulb from coming into contact with the electrode during the process of sealing the glass bulb.

Furthermore, the electrode arrangement may also include two of such protective films, each embodied in a cap-shaped fashion and integrally. One is arranged on the electrode plate and the other is arranged on the connection unit plate. The effects described can thus be achieved both in the region of the electrode plate and in the region of the connection unit plate.

Furthermore, in accordance with one configuration of various embodiments, provision is made for the protective film to include a relief structure, for example in the form of an embossing. By way of example, the protective film can be embodied as pimpled. The respective pimples constitute elevations on a first side of the protective film, while corresponding depressions are situated on the opposite, second side of the protective film. However, this applies not just to pimples, but rather to any desired relief structure. If the protective film were stretched, for example, then said relief structure would be smoothed, at least somewhat. Accordingly, such a relief structure has the effect of reducing the contact area between protective film and quartz glass and thus also further reducing possible material stresses. The risk of flaws or cracks in the quarts glass can thus additionally be reduced.

In a further configuration of various embodiments, the protective film includes a first film part, which is arranged on the plate side facing away from the cylinder and which is embodied in a ring-shaped fashion and has a central circular through opening, through which runs the axis of rotational symmetry of the electrode plate and/or of the connection unit plate. As described, by virtue of the embodiment of this first film part having the circular through opening, the cap-shaped protective film can be placed onto the electrode plate in a simple manner and in this case the electrode can be led through said through opening in a simple manner. Said circular through opening thus accordingly may have a diameter that is at least equal in magnitude to the diameter of the electrode rod or the maximum diameter thereof. If, as described above, the second glass cylinder is subsequently placed onto the electrode or the electrode plate, then said first film part may prevent a direct contact between the molten quartz glass of said second cylinder and the electrode plate.

Furthermore, the protective film also includes a second film part for covering the outer lateral surface of the electrode plate or respectively the connection unit plate. There are then a number of possibilities for the embodiment of said second film part.

In one configuration variant of various embodiments, said second film part includes a plurality of film strips which are connected to one another via the first film part and which are arranged in a manner at least adjoining one another or overlapping one another in a circumferential direction around the outer lateral surface. The starting material of the protective film, that is to say before the latter is shaped to form a cap, can thus be embodied for example as a disk providing the first film part and having lugs attaching to the circumference, e.g. having parallel edges, for example in a star-shaped fashion, wherein said lugs provide the second film part. Said lugs can then be bent over by approximately 90 degrees and thus form the cap shape of the protective film. In this case, it may be provided e.g. if said lugs or film strips directly adjoin one another, such that there are no or only small gaps between the individual film strips between which quartz glass can contact an underlying electrode plate or respectively connection unit plate being sealed in. An embodiment of said film strips having parallel edges, as it were as individual rectangles or rectangular film strips, accordingly has the effect that precisely this allows the realization of said film strips adjoining one another in a circumferential direction of the cap. This embodiment is also particularly material-saving since a complete covering of the lateral surface of the electrode plate or respectively of the connection unit plate can be provided by this embodiment with the least material expenditure. Alternatively, however, the film strips can also be embodied such that they overlap in a circumferential direction. By this means, too, it is possible to provide a complete covering of the outer lateral surface of the electrode plate or respectively of the connection unit plate.

In a further configuration of various embodiments, the second film part for covering the outer lateral surface is formed from a completely continuous material section adjacent to the first film part. The second film part has material overlaps, the extent of which increases with increasing distance from the first film part. In this case, the starting material of the protective film, that is to say before the cap shape thereof is embodied, can be provided merely as a disk. An inner ring of said disk then forms the first film part and the outer ring of said disk forms the second film part, which is thus directly adjacent to the first film part. The outer ring can then be bent vis-à-vis the inner ring by means of a suitable forming method, such as die forming, for example, vis-à-vis the inner ring, as a result of which the cap shape of the protective film is provided. Since an outer lateral surface of the cylinder is shaped from the outer ring in this case, increasing material overlaps also occur with increasing distance from the inner ring, that is to say the first film part. By this means, too, accordingly a cap-shaped and integrally embodied protective film can thus be provided in a particularly simple and cost-effective manner. This protective film, too, is ultimately embodied such that it can completely cover the outer lateral surface of the electrode plate or respectively of the connection unit plate. The width of the outer ring in a radial direction then accordingly corresponds to the height of the electrode plate or respectively connection unit plate or is greater than said height.

In a radial direction away from the first film part, the film strips described above also have a length that is at least equal in magnitude to the height of the electrode plate or respectively connection unit plate in order to be able to completely cover this plate or the outer lateral surface thereof.

Furthermore, various embodiments also relate to a gas discharge lamp including at least one electrode arrangement according to various embodiments or one of the configurations thereof. The effects mentioned for the electrode arrangement according to various embodiments and the configurations thereof are applicable to the gas discharge lamp according to various embodiments in the same way.

The gas discharge lamp can be embodied in the manner as already described in the introduction and may include for example a glass bulb composed of quartz glass, in which the electrode arrangement is arranged at least partly, e.g. with the part providing the electrode, wherein also only a part of the connection unit, such as, for example, a power cable or the like, which is adjacent to the connection unit plate on the side facing away from the cylinder, can be situated outside the glass bulb. Furthermore, the gas discharge lamp can be embodied either as a DC discharge lamp or else as an AC discharge lamp. The gas discharge lamp can be embodied for example as a high-pressure mercury lamp, such as, for example, a short-arc mercury lamp, such as Osram HBO® lamps, for example. Such lamps emit light at least partly in the UV range and can be used for example in the lithographic patterning of semiconductors or structural stages of LCD displays. Moreover, the gas discharge lamp can be embodied as a metal halide lamp or halogen metal-vapor lamp, such as an Osram HMI® lamp, for example. These lamps can be used for general lighting purposes such as, for example, in the case of film and television recordings or entertainment purposes. In principle, the gas discharge lamp can also be embodied as any other gas discharge lamp, such as, for example, also as a noble gas short-arc lamp, such as, for example, as an Osram XBO® lamp, which is generally embodied with a gas mixture including a noble gas, such as argon, xenon, krypton. These lamps also emit light in the visible wavelength range and can likewise be used in traditional and digital film projection.

Furthermore, various embodiments also relate to a protective film for an electrode arrangement according to various embodiments or one of the configurations thereof, wherein the protective film is embodied integrally and in a cap-shaped fashion, such that it is able to be arranged on the electrode plate or the connection unit plate in such a way that the protective film at least for the most part covers a side facing away from the cylinder and an outer lateral surface of the electrode plate or of the connection unit plate. Here, too, the effects described with regard to the electrode arrangement according to various embodiments are applicable to the protective film according to various embodiments in the same way. Furthermore, the further features explained in associated with the electrode arrangement according to various embodiments and the configurations thereof, e.g. with regard to the protective film, also enable the development of the protective film according to various embodiments by further corresponding features. Thus, the protective film here can likewise be formed from molybdenum and may include a relief structure. The cap shape of the protective film can be provided by the two variants described in detail above.

Furthermore, various embodiments also relate to a method for providing a protective film on an electrode arrangement for a discharge lamp, wherein the electrode arrangement is provided, which includes an electrode unit including an electrode and an electrode plate, on which the electrode is arranged, a connection unit for coupling to an energy source, wherein the connection unit includes a connection unit plate, a cylinder composed of an electrically nonconductive material, said cylinder being arranged between the electrode plate and the connection unit plate, and at least one conduction film which is arranged on at least one part of an outer side of the cylinder and extends from the connection unit plate as far as the electrode plate and electrically conductively connects the connection unit plate and the electrode plate to one another. In this case, the protective film is embodied integrally and in a cap-shaped fashion and is arranged on the electrode plate or the connection unit plate in such a way that the protective film at least for the most part, e.g. completely, covers a plate side facing away from the cylinder and an outer lateral surface of the electrode plate or of the connection unit plate.

Here, too, the effects described in association with the electrode arrangement according to various embodiments and the configurations thereof are applicable to the method according to various embodiments in the same way. Furthermore, the substantive features described in association with the electrode arrangement according to various embodiments and the configurations thereof enable the development of the method according to various embodiments by further corresponding method steps.

In one development of the method according to various embodiments, prior to being arranged the protective film is provided in the form of a first film part and a second film part, wherein the first film part is embodied in a ring-shaped fashion and has a central circular through opening, and the second film part is directly adjacent to the first film part in a radial direction and includes a plurality of film strips which extend radially outward and which are connected to one another only via the first film part, wherein in each case two edge boundaries facing one another of two neighboring film strips form an angle with one another that is dimensioned such that when the film strips are bent over around an imaginary separating line between the first film part and the second film part by 90 degrees in order to form a cap shape of the protective film, the two edge boundaries of the respective two neighboring film strips at least bear against one another or overlap. As already described, it is preferred for the film strips to be embodied in a rectangular fashion and accordingly for the edge boundaries of a film strip to run parallel. This automatically results in an angle between edge boundaries facing one another in each case of two neighboring film strips, which angle is dimensioned such that the film strips adjoin one another in the course of bending over or after bending over by 90 degrees. In this case, the number of film strips can vary depending on the application and may be between 4 and 20. It has provided for there to be 12 of such film strips.

In a further development of the method according to various embodiments, prior to being arranged the protective film is provided in the form of a first film part and a second film part, wherein the first film part is embodied in a ring-shaped fashion and has a central circular through opening, and the second film part is likewise embodied in a ring-shaped fashion and is directly adjacent to the first film part in a radial direction, wherein that edge of the protective film which is formed by the second film part is bent over around an imaginary separating line between the first film part and the second film part by 90 degrees in order to form a cap shape of the protective film, such that material overlaps are formed by the second film part, the extent of which material overlaps increases with increasing distance from the first film part. By this means, too, once again, as likewise already described, a cap shape of the protective film can be provided in a particularly simple and cost-effective manner, such that the protective film can completely cover the electrode plate or respectively the connection unit plate at the outer lateral surfaces.

A suitable forming method, such as die forming, for example, can be used for bending over the film strips and also the ring-shaped second film part. This allows particularly cost-effective production of the integrally embodied cap-shaped protective film.

Figure 2:
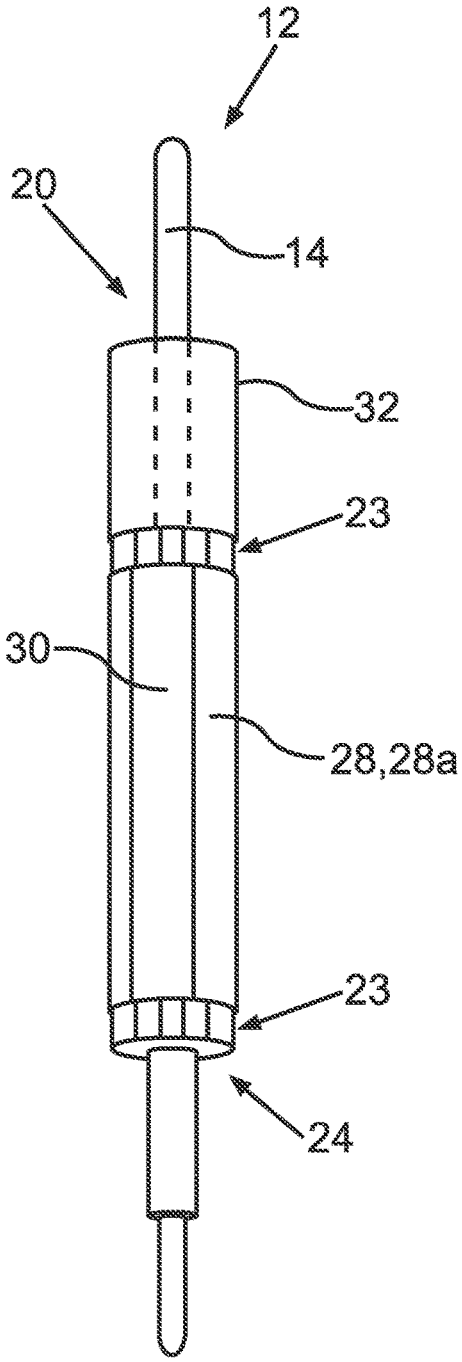
FIG. 2 shows a schematic illustration of an electrode arrangement for a discharge lamp in accordance with various embodiments.

FIG. 1 shows a schematic illustration of a gas discharge lamp 10 including two electrode arrangements 12 in accordance with various embodiments. The electrode arrangements 12 in this case are arranged coaxially with respect to one another, i.e. their respective longitudinal axes A coincide. In this example, the gas discharge lamp 10 is embodied as an AC discharge lamp, but can equally also be embodied as a DC discharge lamp. In various embodiments, an OSRAM HMI® lamp is illustrated in this example. The two electrode arrangements 12 in this case each include an electrode 14, which is arranged in a glass bulb 16 of the gas discharge lamp 10, e.g. is enclosed in said glass bulb 16, which consists of quartz glass, in particular, in an air-tight fashion. The interior 18 of said glass bulb 16 can then be filled with a corresponding gas, depending on the embodiment of the lamp 10, for example a gas including mercury, a noble gas, a halogen, or the like, and also solid constituents such as metal halides, for example. One of these electrode arrangements 12 is illustrated schematically again in FIG. 2.

Such an electrode arrangement 12 thus includes the electrode 14 already mentioned, which can be part of an electrode unit 20 including, besides the electrode 14, also a metallic and thus electrically conductive electrode plate 22 (cf. FIG. 1), which is embodied cylindrically and an which the electrode 14 is arranged centrally. The electrode plate 22 is concealed in FIG. 2 by the protective film 23 yet to be described, but is discernible schematically in cross section in FIG. 1. The electrode arrangement 12 furthermore also includes a connection unit 24, which can provide a power connection and which likewise includes a plate, namely a connection unit plate 26. This connection unit plate 26 is also concealed in FIG. 2 by the protective film 23 yet to be described, but is discernible schematically in cross section in FIG. 1. A cylinder 28 composed of nonconductive material, in particular a glass cylinder 28 composed of quartz glass, is arranged between the electrode plate 22 and the connection unit plate 26. In this case, said cylinder 28 has an outer side 28*a*, simultaneously constituting the lateral surface of the glass cylinder 28, wherein a plurality of electrically conductive conduction films 30, e.g. composed of molybdenum, are arranged on said outer side 28*a*, only one of which conduction films is illustrated here by way of example. In this case, a respective such conduction film 30 electrically conductively connects the connection unit plate 26 to the electrode plate 22, such that current can be passed from the connection unit 24 to the electrode 14 via said conduction film 30 and the electrode plate 22. Said conduction films 30 are very thin, e.g. in the micrometers range, e.g. in the double-digit micrometers range, such as 55 micrometers, for example. On account of this small thickness, differences in the thermal expansion of said conduction films 30 and the glass cylinder 28 and of other glass components do not become apparent. In this case, said conduction films 30 are welded on in the region of the electrode plate 22 and also in the region of the connection unit plate 26. Furthermore, additionally a second glass cylinder 32 can also be placed onto the electrode unit 20 and surround the electrode 14 and also bear on the electrode plate 22 or the protective film 23 situated thereon.

During the production of a gas discharge lamp, such as the one illustrated in FIG. 1, such an electrode unit 12 is then inserted into the glass bulb 16 on both sides, such that the electrode unit 12 is situated in the glass bulb 16 for the most part, e.g. except for a part of the connection unit 24, as can be seen in FIG. 1, and the outer elements of the electrode arrangement 12 are subsequently fused to the glass bulb 16 bearing thereon by means of corresponding heating.

In conventional lamps, molten quartz glass during fusion can touch the current-carrying molybdenum components, such as, for example, the described electrode plate or else the connection unit plate. If quartz and molybdenum components are in direct contact in this case, mechanical stresses arising as a result of the different coefficients of thermal expansion of the materials can lead to cracks in the quartz glass, e.g. in the glass bulb and/or in the cylinder between the plates. In the case of an unfavorable position and direction of propagation, said cracks can in turn result in a defect in the vacuum-tight seal.

The adhering of quartz glass, in particular of the glass bulb 16, and also of the second cylinder 32 to the electrode plate 22, and also to the connection unit plate 26, can then be avoided by means of the protective film 23 already mentioned. The latter is embodied such that it covers a plate side 22*a* facing away from the cylinder 28, and also an outer lateral surface 22*b* of the electrode plate 22, e.g. completely apart from that region of the plate side 22*a* in which the electrode 14 is arranged. Such a protective film 23 can entirely analogously also be arranged on the connection unit plate 26 and likewise be embodied such that it correspondingly covers the plate side 26*a* facing away from the cylinder 28, and an outer lateral surface 26*b* of the connection unit plate 26. Said film 23 furthermore includes a relief structure, such as pimpling, for example, as a result of which said film 23 is able to absorb material stresses in the direction of the film surface. By virtue of the film 23, it may thus be possible to prevent said adhering of quartz glass and also to avoid material stresses between molybdenum and glass, and possibly flaws or cracks resulting therefrom.

It may be provided, then, for said film 23 to be embodied in a cap-shaped fashion and integrally and not to be composed of a plurality of individual parts. Specifically, this may make it possible to arrange said film 23 of the electrode arrangement 12 without welding, e.g. without a welded connection between the outer lateral surface 22*b* and 26*b* of the relevant plates 22 and 26, respectively, and the film. This in turn has the effect that the welds for the conduction films 30 that lie below said film 23 cannot be damaged. The mounting of this cap 23 without securing by means of welding furthermore may have the effect that there are no welding points as starting points for cracks on the circumference. The cap 23 additionally affords the effect that between the end side of the cap 23, which thus bears on the plate side 22*a* and 26*a* of the relevant plates 22 and 26, respectively, and its circumference, which thus bears on the outer lateral surface 22*b* and 26*b* of the relevant plates 22 and 26, respectively, there is a preformed bent edge rather than any cut edges which could likewise be starting points for glass stresses and cracks.

Such a cap-shaped integral molybdenum protective film 23 can then be provided in various ways. A first example is illustrated in FIG. 3 and FIG. 4.

Figure 3:
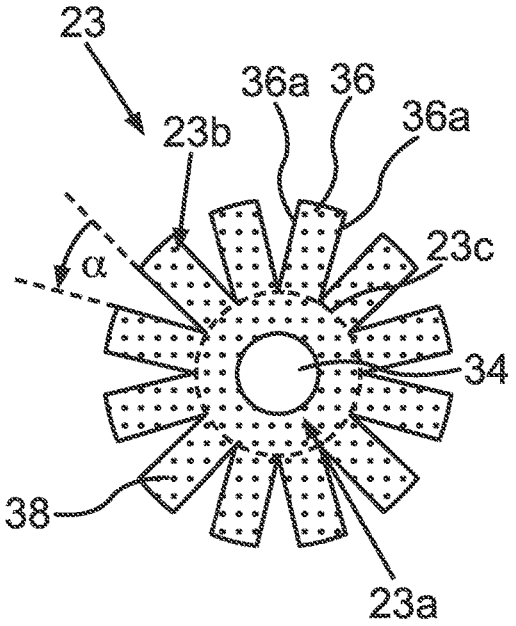
FIG. 3 shows a schematic illustration of the protective film for an electrode arrangement in a plan view prior to shaping the protective film to form a cap, in accordance with various embodiments.
Figure 4:
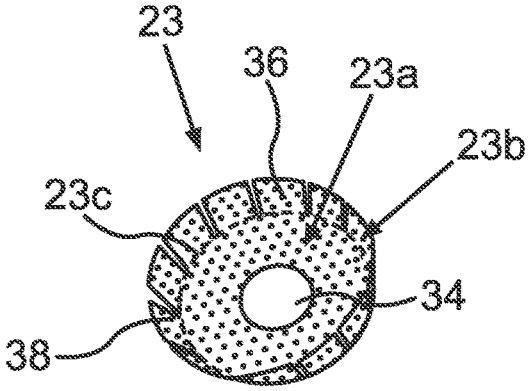
FIG. 4 shows a schematic illustration of the protective film from FIG. 3 after the shaping of the cap in accordance with various embodiments.

In this case, FIG. 3 shows a schematic illustration of the protective film 23 in a plan view prior to shaping to form a cap, and FIG. 4 shows said protective film 23 after shaping to form a cap in accordance with various embodiments. In this example, the protective film is subdivided into a first film part 23*a* and a second film part 23*b*. In this case, the first film part 23*a* is embodied as the inner part and in a ring-shaped fashion and thus has in other words a circular through opening 34. By contrast, the second part 23*b* includes a plurality of individual film strips 36 which are connected to one another over the first film part. An imaginary boundary line between the first film part 23*a* and the second film part 23*b* is designated by 23*c*.

Furthermore, the respective strips 36 have edge boundaries 36*a*, wherein there is an intermediate angle a between in each case two edge boundaries 36*a* facing one another of two neighboring strips 36, said angle being dimensioned such that when the film strips 36 are bent over, as is illustrated in FIG. 4, by 90 degrees in order to form the cap shape, the two edge boundaries 36*a* facing one another of the neighboring film strips 36 are situated at least in a manner adjoining one another. This is the case if $\alpha=360°/n$ or less, wherein n represents the number of film strips 36 around the first film part 23*a*. If $\alpha=360°/n$ holds true for the angle, then this implies that the film strips 36 have two edge boundaries 36 running parallel to one another and are embodied in a rectangular fashion, for example, as illustrated in FIG. 3. In this way, the individual film strips 36, when they are bent over by 90 degrees around the imaginary boundary line 23*c* between first and second film parts 23*a*, 23*b*, directly adjoin one another.

FIG. 3 and FIG. 4 then also reveal the pimpling 38 by the dots illustrated, only one of which is provided with a reference sign for reasons of clarity, as an example of a relief structure of the protective film 23.

Consequently, a cap-shaped protective film 23 can be produced in a simple manner on a star-shaped basic shape, as illustrated in FIG. 3, which protective film can be produced from one piece of material. This cap-shaped and integral protective film 23 can then be placed onto the relevant plates 22, 26 in a simple manner, e.g. as described above, and thus completely cover the respective plate sides 22*a*, 26*a* facing away from the cylinder 28 and also their outer lateral surfaces 22*b*, 26*b*.

Figure 5:
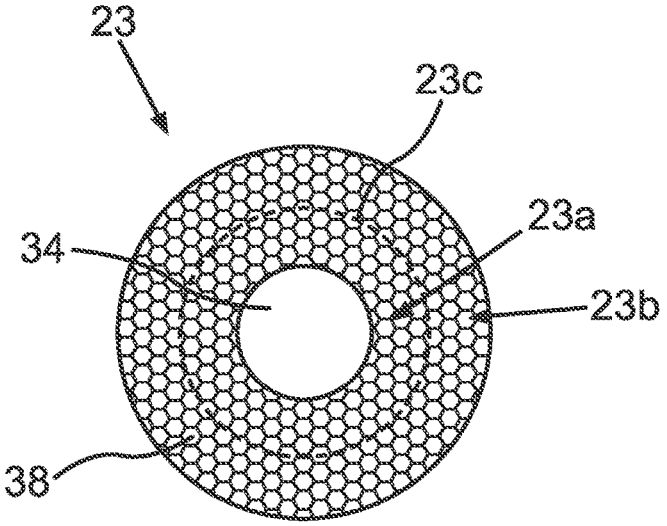
FIG. 5 shows a schematic illustration of the protective film in a plan view prior to the forming process to form a cap in accordance with various embodiments.
Figure 6:
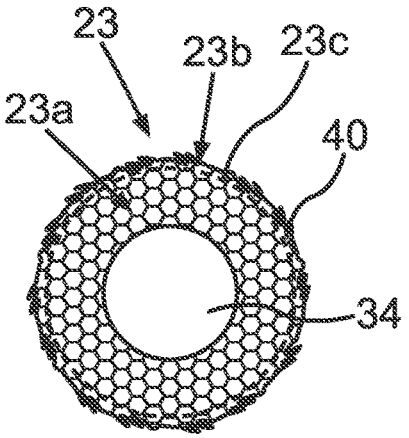
FIG. 6 shows a schematic illustration of the protective film from FIG. 5 after the shaping to form a cap.

A further example of the embodiment of such an integral and cap-shaped protective film 23 is illustrated in FIG. 5 and FIG. 6.

In this case, FIG. 5 once again shows a schematic illustration of the protective film 23 in a plan view prior to shaping to form a cap shape, and FIG. 6 schematically shows said protective film 23 after shaping to form the cap shape in a plan view.

Prior to shaping to form the cap shape, the protective film 23 once again has a ring shape. This, too, can once again be subdivided into a first film part 23*a* and a second film part 23*b*, which are subdivided by an imaginary boundary line 23*c*. The diameter of said imaginary boundary line 23 corresponds in this case, as incidentally also in the case of the previous example from FIG. 3 and FIG. 4, to the diameter of the relevant plates 22, 26 on the arrangement of which the protective film 23 is provided. In this example, too, the protective film 23 again has a circular through opening 34 which is arranged in the center of this protective film 23 embodied in a ring-shaped fashion and the diameter of which once again corresponds to the diameter of the electrode 14.

The first film part 23*a* can be embodied identically to the embodiment from FIG. 3 and FIG. 4, namely in a ring-shaped fashion. However, in this example, the second film part 23*b* does not consist of individual strips, but rather is likewise embodied as a continuous ring that is directly adjacent to the first film part 23*a* in a radial direction. By means of a suitable forming method, such as by means of die forming, for example, this outer ring provided by the second film part 23*b* can then likewise be bent around the imaginary boundary line 23*c* by 90 degrees, thus resulting in the cap-shaped shape of the protective film 23, as illustrated in FIG. 6. In this case, material overlaps then occur in the region of the second film part 23*b*, one of which is provided with the reference sign 40 in FIG. 6. These material overlaps 40 become all the greater or increase all the more, the greater the distance from the first film part 23*a*. This is owing to the fact that the increasing radius of the outer second film part 23*b* is pressed onto a smaller radius during the process of forming the cap shape.

In this case, too, once again the reference sign 38 is intended to elucidate the relief structure of the protective film 23, which is illustrated as a honeycomb structure in FIG. 5. By means of this example, too, an integrally embodied molybdenum cap can be provided, which can then be arranged in a simple manner on the desired plate 22 and/or 26 and covers the plate side 22*a* and/or 26*a*, respectively, and also the outer lateral surface 22*b*, 26*b* thereof.

The starting material, as illustrated in FIG. 3 and FIG. 5, can thus simply be inserted into a die, consisting of lower die and upper die, and be formed into a cap.

Overall, the examples show how the invention makes it possible to provide a molybdenum cap for discharge lamps with an all-round film system, which cap enables a particularly efficient covering of the electrode plate and optionally also of the connection unit plate, without having to be secured to the electrode arrangement by welding. As a result, it is possible advantageously to avoid possible material stresses and flaws or cracks resulting therefrom, and also possible damage to welded connections of underlying conduction films.

LIST OF REFERENCE SIGNS

10 Gas discharge lamp
12 Electrode arrangement
14 Electrode
16 Glass bulb
18 Interior
20 Electrode unit
22 Electrode plate
22*a* Plate side
22*b* Outer lateral surface
23 Protective film
23*a* First film part
23*b* Second film part
23*c* Boundary line
24 Connection unit
26 Connection unit plate
26*a* Plate side
26*b* Outer lateral surface
28 Cylinder
28*a* Outer side
30 Conduction film
32 Cylinder
34 Through opening
36 Strip
36*a* Edge boundary
38 Pimpling
40 Material overlap
α Intermediate angle
A Axis While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. An electrode arrangement for a discharge lamp, the electrode arrangement comprising:

an electrically conductive electrode unit comprising an electrode and an electrode plate, on which the electrode is arranged;

an electrically conductive connection unit for coupling to an energy source, wherein the connection unit comprises a connection unit plate;

a cylinder composed of an electrically nonconductive material, said cylinder being arranged between the electrode plate and the connection unit plate; and at least one electrically conductive conduction film which is arranged on at least one part of an outer side of the cylinder and extends from the connection unit plate as far as the electrode plate and electrically conductively connects the connection unit plate and the electrode plate to one another;

wherein the electrode arrangement comprises a cap-shaped and integrally embodied protective film arranged on the electrode plate or connection unit plate, such that the protective film at least for the most part covers a plate side facing away from the cylinder and an outer lateral surface of the electrode plate or of the connection unit plate.

2. The electrode arrangement of claim 1, wherein the protective film comprises a relief structure.

3. The electrode arrangement of claim 1, wherein the protective film comprises a first film part, which is arranged on the plate side facing away from the cylinder and which is embodied in a ring-shaped fashion and has a central circular through opening, through which runs the axis of rotational symmetry of the electrode plate and/or of the connection unit plate.

4. The electrode arrangement of claim 1, wherein the protective film comprises a second film part for covering the outer lateral surface, wherein the second film part comprises a plurality of film strips which are connected to one another via the first film part and which are arranged in a manner at least adjoining one another or overlapping one another in a circumferential direction around the outer lateral surface.

5. The electrode arrangement of claim 1, wherein the protective film comprises a second film part for covering the outer lateral surface, said second film part being formed from a completely continuous material section adjacent to the first film part, wherein the second film part has material overlaps, the extent of which increases with increasing distance from the first film part.

6. A gas discharge lamp, comprising:

at least one electrode arrangement, comprising:

an electrically conductive electrode unit comprising an electrode and an electrode plate, on which the electrode is arranged;

an electrically conductive connection unit for coupling to an energy source, wherein the connection unit comprises a connection unit plate;

a cylinder composed of an electrically nonconductive material, said cylinder being arranged between the electrode plate and the connection unit plate; and at least one electrically conductive conduction film which is arranged on at least one part of an outer side of the cylinder and extends from the connection unit plate as far as the electrode plate and electrically conductively connects the connection unit plate and the electrode plate to one another;

wherein the electrode arrangement comprises a cap-shaped and integrally embodied protective film arranged on the electrode plate or connection unit plate, such that the protective film at least for the most part covers a plate side facing away from the cylinder and an outer lateral surface of the electrode plate or of the connection unit plate.

7. A protective film for an electrode arrangement, the electrode arrangement comprising:

an electrically conductive electrode unit comprising an electrode and an electrode plate, on which the electrode is arranged;

an electrically conductive connection unit for coupling to an energy source, wherein the connection unit comprises a connection unit plate;

a cylinder composed of an electrically nonconductive material, said cylinder being arranged between the electrode plate and the connection unit plate; and at least one electrically conductive conduction film which is arranged on at least one part of an outer side of the cylinder and extends from the connection unit plate as far as the electrode plate and electrically conductively connects the connection unit plate and the electrode plate to one another;

wherein the electrode arrangement comprises a cap-shaped and integrally embodied protective film arranged on the electrode plate or connection unit plate, such that the protective film at least for the most part covers a plate side facing away from the cylinder and an outer lateral surface of the electrode plate or of the connection unit plate;

wherein the protective film is embodied integrally and in a cap-shaped fashion, such that it is able to be arranged on the electrode plate or the connection unit plate in such a way that the protective film at least for the most part covers a plate side facing away from the cylinder and an outer lateral surface of the electrode plate or of the connection unit plate.

8. A method for providing a protective film on an electrode arrangement for a discharge lamp, the method comprising:

providing the electrode arrangement, which comprises:

an electrode unit comprising an electrode and an electrode plate, on which the electrode is arranged;

a connection unit for coupling to an energy source, wherein the connection unit comprises a connection unit plate;

a cylinder composed of an electrically nonconductive material, said cylinder being arranged between the electrode plate and the connection unit plate; and at least one conduction film which is arranged on at least one part of an outer side of the cylinder and extends from the connection unit plate as far as the electrode plate and electrically conductively connects the connection unit plate and the electrode plate to one another;

embodying the protective film integrally and in a cap-shaped fashion and arranging on the electrode plate or the connection unit plate in such a way that the protective film at least for the most part covers a plate side facing away from the cylinder and an outer lateral surface of the electrode plate or of the connection unit plate.

9. The method of claim 8, wherein prior to being arranged the protective film is provided in the form of a first film part and a second film part, wherein the first film part is embodied in a ring-shaped fashion and has a central circular through opening, and the second film part is directly adjacent to the first film part in a radial direction and comprises a plurality of film strips which extend radially outward and which are connected to one another only via the first film part, wherein in each case two edge boundaries facing one another of two neighboring film strips form an angle with one another that is dimensioned such that when the film strips are bent over around an imaginary separating line between the first film part and the second film part by 90 degrees in order to form a cap shape of the protective film, the two edge boundaries facing one another of the respective two neighboring film strips at least bear against one another or overlap.

10. The method of claim 8, wherein prior to being arranged the protective film is provided in the form of a first film part and a second film part, wherein the first film part is embodied in a ring-shaped fashion and has a central circular through opening, and the second film part is likewise embodied in a ring-shaped fashion and is directly adjacent to the first film part in a radial direction, wherein that edge of the protective film which is formed by the second film part is bent over around an imaginary separating line between the first film part and the second film part by 90 degrees in order to form a cap shape of the protective film, such that material overlaps are formed by the second film part, the extent of which material overlaps increases with increasing distance from the first film part.

* * * * *